US006360391B1

(12) United States Patent
Goodall

(10) Patent No.: US 6,360,391 B1
(45) Date of Patent: Mar. 26, 2002

(54) UTILITY BELT BUCKLE DEVICE

(76) Inventor: Quorosh W. Goodall, 7 School Lane, Emmer Green, Reading, Berkshire RG4 8LL (GB)

( * ) Notice: Subject to any disclaimer, the term of this patent is extended or adjusted under 35 U.S.C. 154(b) by 0 days.

(21) Appl. No.: 09/616,913

(22) Filed: Jul. 14, 2000

(51) Int. Cl.[7] ..... B25F 1/00; B67B 7/16
(52) U.S. Cl. ..... 7/151; 224/163
(58) Field of Search ..... 7/151; 24/163 R; 224/163, 904

(56) References Cited

U.S. PATENT DOCUMENTS 2,807,085 A 9/1957 Combs
3,175,233 A 3/1965 Caravella
3,823,422 A 7/1974 Forgett, Jr.
4,078,272 A 3/1978 Mahon, III
4,135,267 A 1/1979 Mckinney, Sr. et al.
D260,634 S 9/1981 Gates

*Primary Examiner*—D. S. Meislin

(57) ABSTRACT

A utility belt buckle device for removing caps from bottles. The utility belt buckle device includes a base portion and a cover portion. The cover portion has an aperture therein. The aperture is elongate. A hinge assembly hingedly couples the cover portion to the base portion. A locking assembly releasably locks the cover portion in the closed position. The locking assembly includes a slot, which extends through base portion. A latch is fixedly coupled to the cover portion. The latch is positioned such that the latch may extend through the slot when the cover portion is abutted against the base portion. An actuating means selectively holds and releases the latch from the slot. A coupling means removably couples the base portion to a user. The coupling means comprises a strap having the strap has a first end and a second end and a coupling assembly fixedly mounted on the base portion for removably coupling the first and second ends of the strap to the base portion.

9 Claims, 4 Drawing Sheets

UTILITY BELT BUCKLE DEVICE

BACKGROUND OF THE INVENTION

1. Field of the Invention

The present invention relates to utility belt buckle devices and more particularly pertains to a new utility belt buckle device for removing caps from bottles.

2. Description of the Prior Art

The use of utility belt buckle devices is known in the prior art. More specifically, utility belt buckle devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,175,233; U.S. Pat. No. 2,807,085; U.S. Pat. No. 4,135,267; U.S. Pat. No. 4,078,272; U.S. Pat. No. 3,823,422; and U.S. Pat. No. 260,634.

While these devices fulfill their respective, particular objectives and requirements, the aforementioned patents do not disclose a new utility belt buckle device. The inventive device includes a base portion and a cover portion. The cover portion has an aperture therein. The aperture is elongate. A hinge assembly hingedly couples the cover portion to the base portion. A locking assembly releasably locks the cover portion in the closed position. The locking assembly includes a slot, which extends through base portion. A latch is fixedly coupled to the cover portion. The latch is positioned such that the latch may extend through the slot when the cover portion is abutted against the base portion. An actuating means selectively holds and releases the latch from the slot. A coupling means removably couples the base portion to a user. The coupling means comprises a strap having the strap has a first end and a second end and a coupling assembly fixedly mounted on the base portion for removably coupling the first and second ends of the strap to the base portion.

In these respects, the utility belt buckle device according to the present invention substantially departs from the conventional concepts and designs of the prior art, and in so doing provides an apparatus primarily developed for the purpose of removing caps from bottles.

SUMMARY OF THE INVENTION

In view of the foregoing disadvantages inherent in the known types of utility belt buckle devices now present in the prior art, the present invention provides a new utility belt buckle device construction wherein the same can be utilized for removing caps from bottles.

The general purpose of the present invention, which will be described subsequently in greater detail, is to provide a new utility belt buckle device apparatus and method which has many of the advantages of the utility belt buckle devices mentioned heretofore and many novel features that result in a new utility belt buckle device which is not anticipated, rendered obvious, suggested, or even implied by any of the prior art utility belt buckle devices, either alone or in any combination thereof.

To attain this, the present invention generally comprises a base portion and a cover portion. The cover portion has an aperture therein. The aperture is elongate. A hinge assembly hingedly couples the cover portion to the base portion. A locking assembly releasably locks the cover portion in the closed position. The locking assembly includes a slot, which extends through base portion. A latch is fixedly coupled to the cover portion. The latch is positioned such that the latch may extend through the slot when the cover portion is abutted against the base portion. An actuating means selectively holds and releases the latch from the slot. A coupling means removably couples the base portion to a user. The coupling means comprises a strap having the strap has a first end and a second end and a coupling assembly fixedly mounted on the base portion for removably coupling the first and second ends of the strap to the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new utility belt buckle device apparatus and method which has many of the advantages of the utility belt buckle devices mentioned heretofore and many novel features that result in a new utility belt buckle device which is not anticipated, rendered obvious, suggested, or even implied by any of the prior art utility belt buckle devices, either alone or in any combination thereof.

It is another object of the present invention to provide a new utility belt buckle device which may be easily and efficiently manufactured and marketed.

It is a further object of the present invention to provide a new utility belt buckle device which is of a durable and reliable construction.

An even further object of the present invention is to provide a new utility belt buckle device which is susceptible of a low cost of manufacture with regard to both materials and labor, and which accordingly is then susceptible of low prices of sale to the consuming public, thereby making such utility belt buckle device economically available to the buying public.

Still yet another object of the present invention is to provide a new utility belt buckle device which provides in the apparatuses and methods of the prior art some of the advantages thereof, while simultaneously overcoming some of the disadvantages normally associated therewith.

Still another object of the present invention is to provide a new utility belt buckle device for removing caps from bottles.

Yet another object of the present invention is to provide a new utility belt buckle device which includes a base portion and a cover portion. The cover portion has an aperture therein. The aperture is elongate. A hinge assembly hingedly couples the cover portion to the base portion. A locking assembly releasably locks the cover portion in the closed position. The locking assembly includes a slot, which extends through base portion. A latch is fixedly coupled to the cover portion. The latch is positioned such that the latch may extend through the slot when the cover portion is abutted against the base portion. An actuating means selectively holds and releases the latch from the slot. A coupling means removably couples the base portion to a user. The coupling means comprises a strap having the strap has a first end and a second end and a coupling assembly fixedly mounted on the base portion for removably coupling the first and second ends of the strap to the base portion.

Still yet another object of the present invention is to provide a new utility belt buckle device that may be used without a need to remove the device from the user's body.

Even still another object of the present invention is to provide a new utility belt buckle device that allows a user to open bottles without the need of a stand alone bottle opener.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
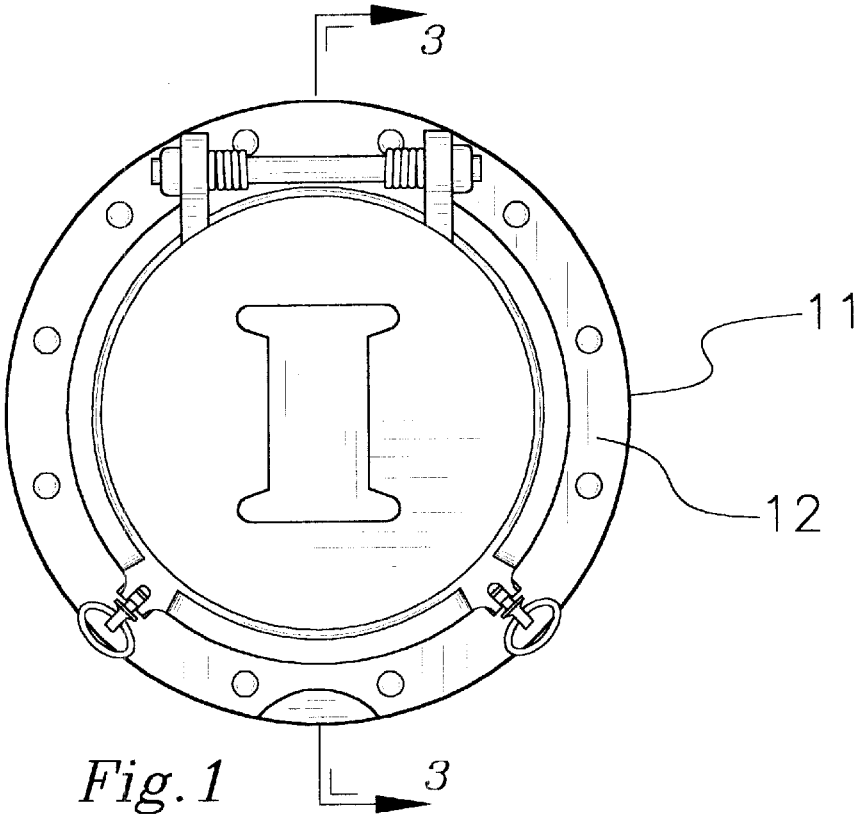
FIG. 1 is a schematic plan view of a new utility belt buckle device according to the present invention.
Figure 2:
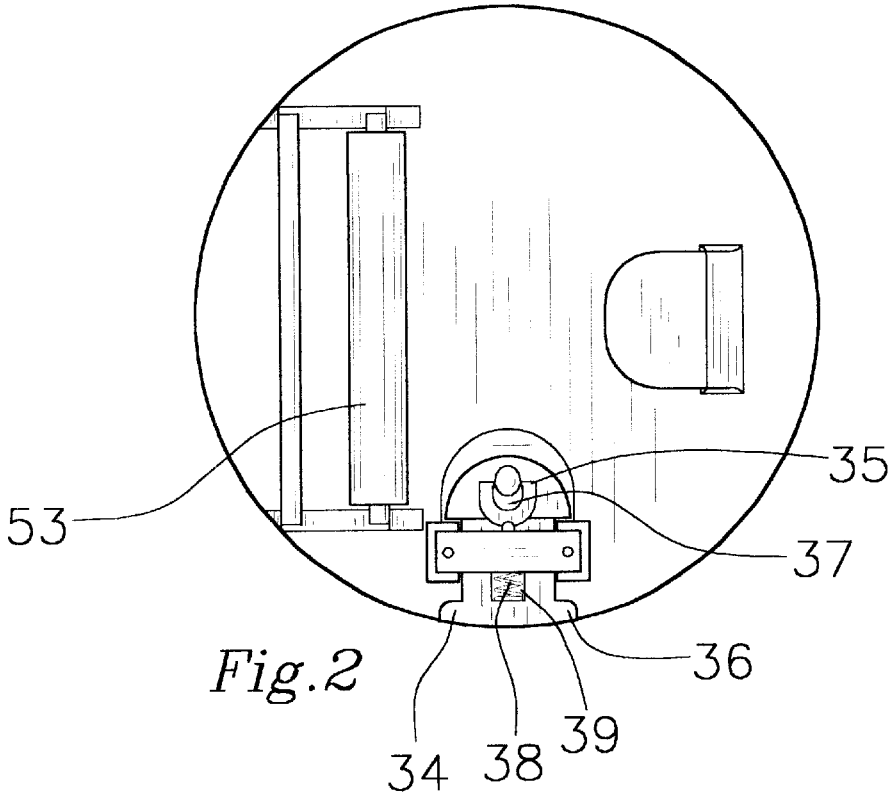
FIG. 2 is a schematic back view of the present invention.

With reference now to the drawings, and in particular to FIGS. 1 through 9 thereof, a new utility belt buckle device embodying the principles and concepts of the present invention and generally designated by the reference numeral 10 will be described.

As best illustrated in FIGS. 1 through 9, the utility belt buckle device 10 generally comprises a base portion 11. The base portion 11 has a top surface 12, a bottom surface 13 and a peripheral wall 14 therebetween. The base portion 11 has a distal portion 15, a middle portion 16 and a proximal portion 17. The top 12 and bottom 13 surfaces ideally have a circular shape. The bottom surface of the base portion 11 is preferably concave to aid in comfort of wear for the user.

A cover portion 18 has a front side 19, a back side 20 and a peripheral wall 21 therebetween. The cover portion 18 has an aperture 22 therein which preferably has an I-shape. The front 19 and back sides 20 of the cover portion 18 are generally planar and have a generally circular shape. The top surface 12 of the base portion 11 has a raised portion 23 thereon. The raised portion 23 has a shape and size adapted to fit in the aperture 22 in the cover portion 18. The raised portion 23 has a height such that when the cover portion 1 8 is abutted against the base portion 11, the raised portion 23 is generally flush with the front side 19 of the cover portion 18.

Figure 3A:
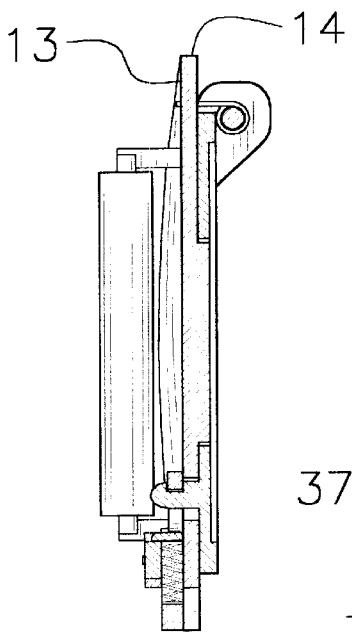
FIG. 3*a* is a schematic side view of the present invention in a closed position.
Figure 3B:
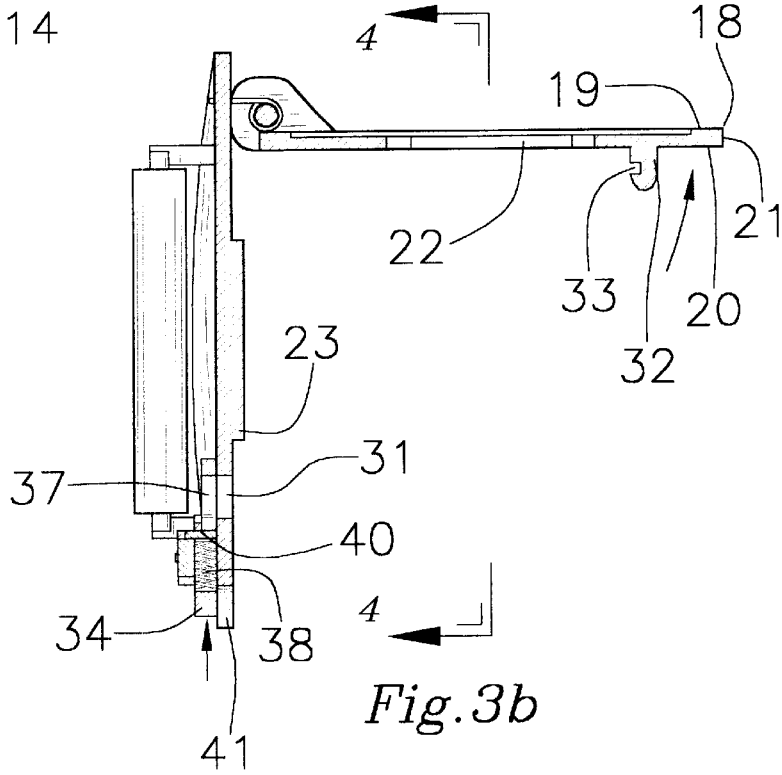
FIG. 3*b* is a schematic side view of the present invention in an open position.

A hinge assembly 24 hingedly couples the cover portion 18 to the base portion 11 such that the cover portion 18 moves between an open position and a closed position. The closed position is defined by the back side 20 of the cover portion 18 being abutted against the top surface 12 of the bottom portion 11 as is shown in FIG. 3*a*.

The hinge assembly 24 includes a pair of protruding members 25. Each of the protruding members 25 is integrally coupled to the top surface 12 of the base portion 11. The protruding members 25 are spaced from each other. The protruding members 25 are generally positioned in the distal portion 15 of the base portion 11. Each of the protruding members 25 has a bore therein. The bores are generally axially aligned with each other.

A pair of upstanding members 26 is each fixedly coupled to and extending away from a juncture of the front side 19 and peripheral wall 21 of the cover portion 18. The upstanding members 26 are spaced from each other but are positioned that they fit between the protruding members 25 such that each of the upstanding members 26 is abutted against an inside portion of the protruding members 25. Each of the upstanding members 26 has a bore therethrough. The bores in the upstanding members 26 are generally axially aligned with the bores in the protruding members 25.

A pivot pin 27 extends through each of the bores in the protruding members 25 and the upstanding members 26. The pivot pin 27 is fixedly coupled to each of the protruding members 25 and rotatably coupled to the upstanding members 26.

A biasing means 28 biases the cover portion 18 in the open position. The biasing means 28 is a spring. The spring 28 is wrapped about the pivot pin 27. The spring has a pair of ends 29. Each of the ends 29 extends into the top surface 12 of the base portion 11. Each of the ends 29 is generally located adjacent to one of the upstanding members 26. A middle portion 30 of the spring is fixedly coupled to the peripheral wall 21 of the cover portion 18 and is located within a channel in the peripheral wall 21 of the cover portion 18.

A locking assembly releasably locks the cover portion 18 in the closed position. The locking assembly includes a slot 31. The slot 31 extends through the top 12 and bottom surfaces 13 of the base portion 11. The slot 31 is generally positioned in the proximal portion 17 of the base portion 11 A latch 32 is fixedly coupled to the back side 20 of the cover portion 18. The latch 32 is positioned such that the latch 32 may extend through the slot 31 when the cover portion 18 is in the closed portion. The latch 32 has notch 33 therein. The notch 33 generally faces the pivot bar 27.

An actuating means 34 selectively holds and releases the latch 32 from the slot 31. The actuating means 34 is generally located between the slot 31 and the peripheral wall 14 of the base portion 11. The actuating means 34 comprising a lever. The lever 34 is slidably mounted to and flush against the bottom surface 13 of the base portion 11. The lever 34 has a first end 35 and a second end 36. The second end 35 is generally adjacent to the peripheral wall 14 of the base portion 11. The lever 34 has a bore 37 therein. The bore 37 is generally adjacent to the first end 35 of the lever 34. The bore 37 in the lever 34 may be slidably positioned over the slot 31 in the base portion 11 such that the bore 37 in the lever 34 may receive the latch 32. The lever 34 may be slidably positioned in a locked position such that the notch 33 in the latch 32 receives a portion of the lever 34 as is depicted in FIG. 3*a*.

A biasing means 38 biases the lever in the locked position. The biasing means 38 is a spring which is mounted in a channel 39 in the lever 34. A wall 40 extends upward from and is integrally coupled to the bottom surface 13 of the base portion 11. The wall extends 40 into the channel 39 such that the spring is biased against the wall 40. The wall 40 is positioned between the spring and the first end 35 of the lever 34.

A depression 41 in the peripheral wall 14 of the base portion 11 aids in actuating the actuating means. The depression 41 is generally adjacent to the second end 36 of the lever 34.

A coupling means removably couples the base portion 11 to a user. The coupling means includes a strap 50. The strap 50 has a first end 51 and a second end 52. The second end 52 has a hook portion thereon.

A bar 53 is rotatably coupled to the bottom surface 13 of the base portion 11. The bar 53 is generally adjacent to the peripheral wall 14 of the base portion 11. The bar 53 has a longitudinal axis orientated generally perpendicular to the pivot pin 27.

A bracket 54 having a first leg 55 and a second leg 56 is generally L-shaped. A free end of the first leg 55 is fixedly coupled to the bottom surface 13 of the base portion 11 such that the second leg 56 extends toward the bar 53. The bracket 54 is positioned generally adjacent to the peripheral wall 14 of the base portion 11. The first end 51 of the strap may be slidably wrapped around the bar 53 and wherein the hook portion 52 may be releasably coupled to the bracket 54.

Figure 7:
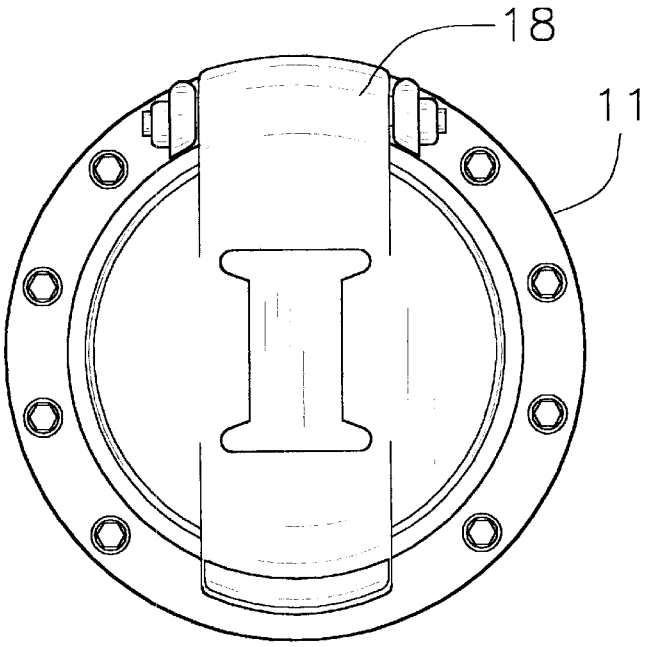
FIG. 7 is a schematic plan view of the second embodiment of the present invention.
Figure 8:
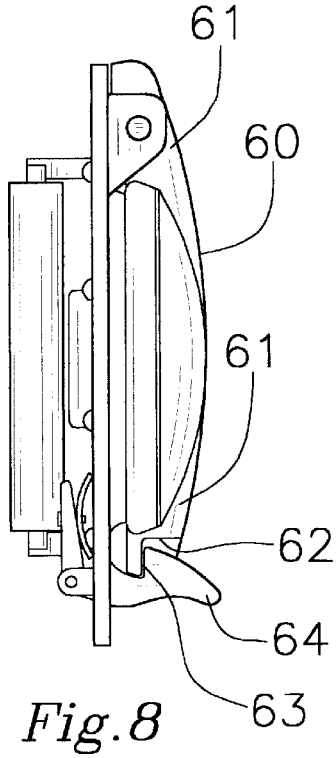
FIG. 8 is a schematic side view of the second embodiment of the present invention.
Figure 9:
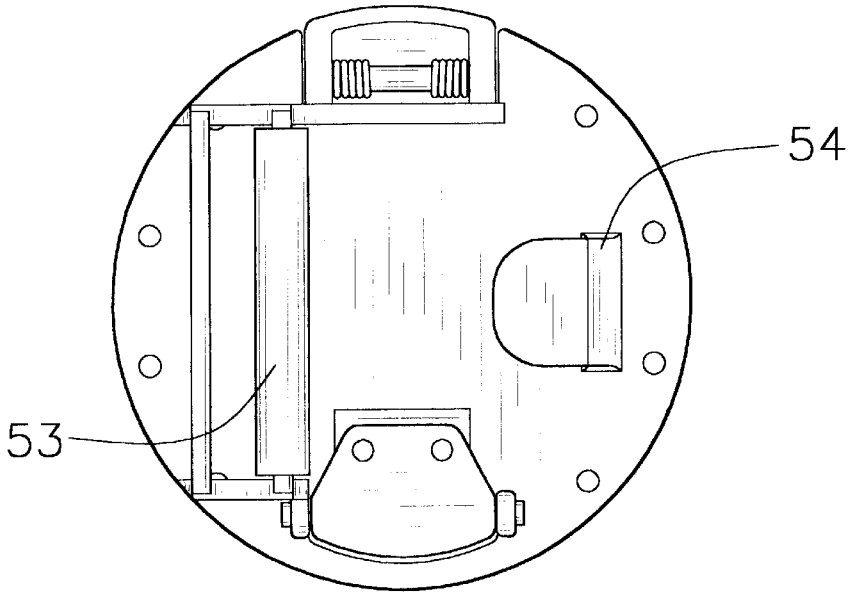
FIG. 9 is a schematic back view of the second embodiment of the present invention.

A second embodiment is depicted in FIGS. 7, 8 and 9. The base portion 11 in the second embodiment has a convex top surface 12 and the cover portion 18 has a middle portion 60 having a width measuring less width than the outside ends 61 of the cover portion. This allows the top surface 12 of the base portion 11 to be substantially flush with the front side 19 of the cover 18 such that a raised portion is not needed. The locking assembly on the second embodiment uses a shoulder 62 carved into the cover portion 18. The lever 64 extends away from the base,member 11 and has a catch 63 therein for communicating with the shoulder 62. The lever 64 is pressed away from the shoulder 62, which allows the cover portion 18 to open.

Figure 4:
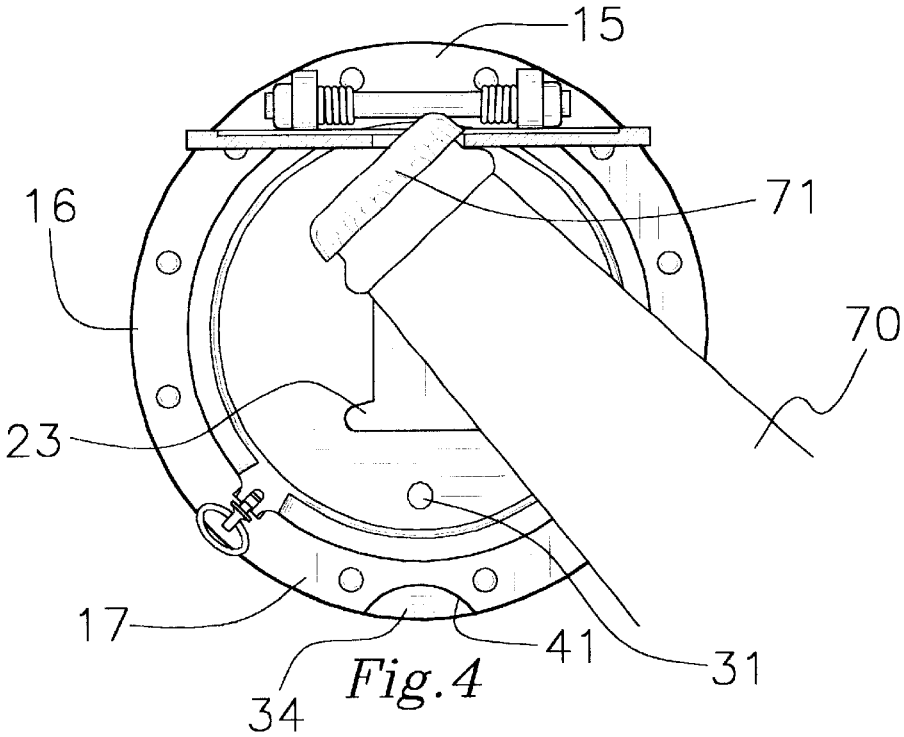
FIG. 4 is a schematic front view of the present invention in an open position.
Figure 5:
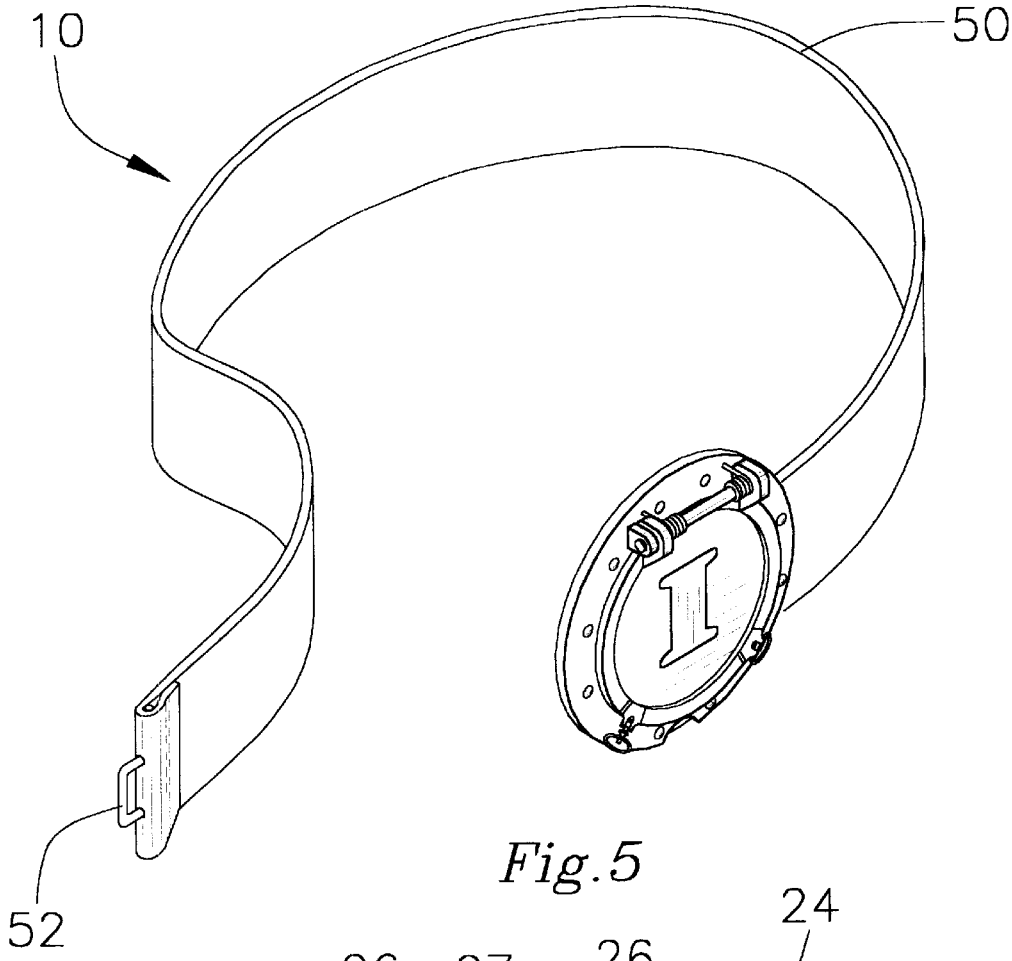
FIG. 5 is a schematic perspective view of the present invention.
Figure 6:
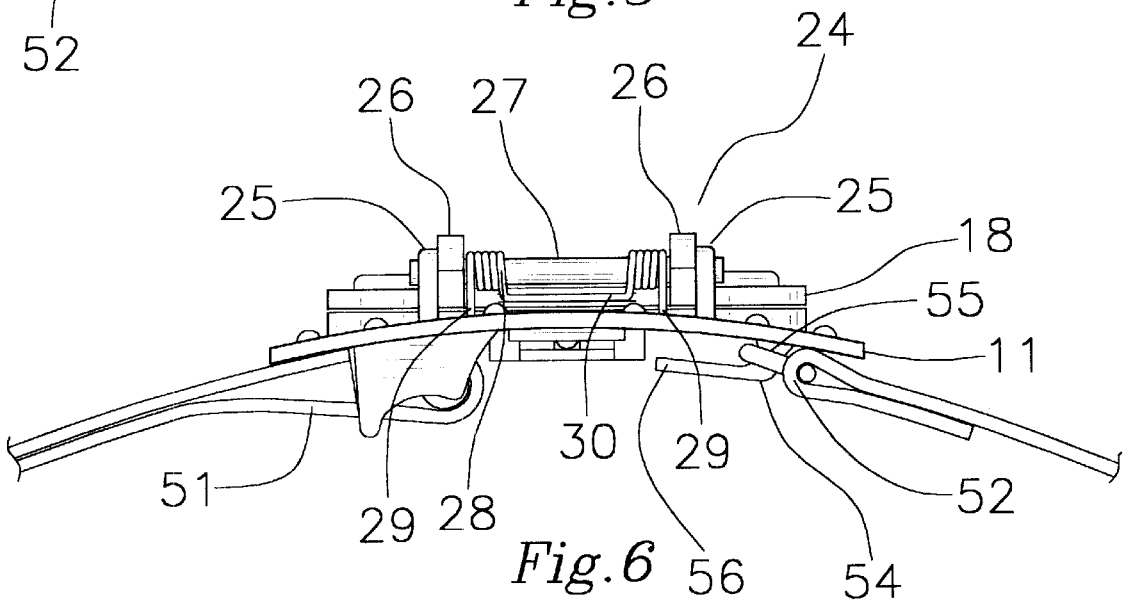
FIG. 6 is a schematic end view of the present invention.

In use, the belt buckle device 10 is worn, as is any other belt buckle. The design of the coupling means to couple the device to the 50 strap may take the form of any conventional coupling means. When the user has a bottle 70 to open, the cover portion 18 is placed in the open position and the cap 71 of the bottle 70 is placed in the aperture 22 as depicted in FIG. 4 and used as a typical bottle opener.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A utility belt buckle device, said belt buckle device comprising:

a base portion;

a cover portion, said cover portion having an aperture therein, said aperture being elongate;

a hinge assembly for hingedly coupling said cover portion to said base portion;

a locking assembly for releasably locking said cover portion in said closed position, said locking assembly comprising:

a slot, said slot extending through base portion;

a latch, said latch being fixedly coupled to said cover portion, said latch being positioned such that said latch may extend through said slot when said cover portion is abutted against said base portion, an actuating means for selectively holding and releasing said latch from said slot;

a coupling means for removably coupling said base portion to a user, said coupling means comprising;

a strap, said strap having a first end and a second end; and a coupling assembly fixedly mounted on said base portion for removably coupling said first and second ends of said strap to said base portion.

2. The utility belt buckle device as in claim 1, said base and cover portions comprising:

said base portion having a top surface, a bottom surface and a peripheral wall therebetween, said base portion having a distal portion, a middle portion and a proximal portion; and said cover portion having a front side, a back side and a peripheral wall therebetween, said aperture generally having an I-shape, said front and back sides of said cover portion being generally planar and having a generally circular shape, said top surface of said base portion having a raised portion thereon, said raised portion having a shape and size adapted to fit in said aperture in said cover portion.

3. The utility belt buckle device as in claim 2, wherein said hinge assembly comprises:

a pair of protruding members, each of said protruding members each being integrally coupled to said top surface of said base portion, said protruding members being spaced and generally positioned in said distal portion of said base portion, each of said protruding members having a bore therein, said bores being generally axially aligned;

a pair of upstanding members, each of said upstanding members being fixedly coupled to and extending away from a juncture of said front side and said peripheral wall of said cover portion, said upstanding members being spaced and adapted to fit between said protruding members, each of said upstanding members having a bore therethrough, said bores in said upstanding members being generally axially aligned with said bores in said protruding members; and a pivot pin, said pivot pin extending through each of said bores in said protruding members and said upstanding members, said pivot pin being fixedly coupled to each of said protruding members.

4. The utility belt buckle device as in claim 3, wherein said hinge assembly further comprises:

a biasing means for biasing said cover portion in said open position, said biasing means being a spring, said spring being wrapped about said pivot pin, said spring having a pair of ends, each of said ends extending into said top surface of said base portion, each of said ends being generally located adjacent to one of said upstanding members, a middle portion of said spring being fixedly coupled to said peripheral wall of said cover portion.

5. The utility belt buckle device as in claim 2, wherein said locking assembly further comprises:

the slot extending through said top and bottom surface of said base portion, said slot being generally positioned in said proximal portion of said base portion;

the latch being fixedly coupled to said back side of said cover portion, said latch being positioned such that said latch may extend through said slot when said cover portion is in said closed portion, said latch having notch therein; and said actuating means being generally located between said slot and said peripheral wall of said base portion, said actuating means comprising a lever, said lever being slidably mounted to said bottom surface of said base portion, said lever being positioned to slide over said slot, said lever having a bore therein for receiving said latch.

6. The utility belt buckle device as in claim 5, wherein said actuating means further comprises:

said lever having a first end and a second end, said second end being generally adjacent to said peripheral wall of said base portion, said bore in said lever being generally adjacent to said first end of said lever, wherein said lever may be slidably positioned in a locked position such that said notch in said latch receives a portion of said lever; and a biasing means for biasing said lever in said locked position, said biasing means being a spring, said spring being mounted in a channel in said lever, a wall extending upward from and integrally coupled to said bottom surface of said base portion, said wall extending into said channel such that said spring is biased against said wall, said wall being positioned between said spring and said first end of said lever.

7. The utility belt buckle device as in claim 6, further comprising:

a depression in said peripheral wall of said base portion, said depression being generally adjacent to said second end of said lever.

8. The utility belt buckle device as in claim 2, wherein said coupling means comprises:

said strap having a first end and a second end, said second end having a hook portion thereon;

said coupling assembly comprising:

a bar, said bar being rotatably coupled to said bottom surface of said base portion, said bar being generally adjacent to said peripheral wall of said base portion, said bar having a longitudinal axis orientated generally perpendicular to said pivot pin;

a bracket, said bracket having a first leg and a second leg, said bracket being generally L-shaped, a free end of said first leg being fixedly coupled to said bottom surface of said base portion such that said second leg extends toward said bar, said bracket being positioned generally adjacent to said peripheral wall of said base portion; and wherein said first end of said strap may be slidably wrapped around said bar and wherein said hook portion may be releasably coupled to said bracket.

9. A utility belt buckle device, said belt buckle device comprising:

a base portion, said base portion having a top surface, a bottom surface and a peripheral wall therebetween, said base portion having a distal portion, a middle portion and a proximal portion, said top and bottom surfaces generally having a circular shape;

a cover portion, said cover portion having a front side, a back side and a peripheral wall therebetween, said cover portion having an aperture therein, said aperture generally having an I-shape, said front and back sides of said cover portion being generally planar and having a generally circular shape, said top surface of said base portion having a raised portion thereon, said raised portion having a shape and size adapted to fit in said aperture in said cover portion;

a hinge assembly for hingedly coupling said cover portion to said base portion such that said cover portion moves between an open position and a closed position, wherein said closed position is defined by said back side of said cover portion being generally abutted against said top surface of said bottom portion, said hinge assembly comprising:

a pair of protruding members, each of said protruding members each being integrally coupled to said top surface of said base portion, said protruding members being spaced, each of said protruding members being generally positioned in said distal portion of said base portion, each of said protruding members having a bore therein, said bores being generally axially aligned;

a pair of upstanding members, each of said upstanding members being fixedly coupled to and extending away from a juncture of said front side and said peripheral wall of said cover portion, said upstanding members being spaced, each of said upstanding members being positioned such that each of said upstanding members may be abutted against an inside portion of said protruding members, each of said upstanding members having a bore therethrough, said bores in said upstanding members being generally axially aligned with said bores in said protruding members;

a pivot pin, said pivot pin extending through each of said bores in said protruding members and said upstanding members, said pivot pin being fixedly coupled to each of said protruding members and rotatably coupled to said upstanding members;

a biasing means for biasing said cover portion in said open position, said biasing means being a spring, said spring being wrapped about said pivot pin, said spring having a pair of ends, each of said ends extending into said top surface of said base portion, each of said ends being generally located adjacent to one of said upstanding members, a middle portion of said spring being fixedly coupled to said peripheral wall of said cover portion;

a locking assembly for releasably locking said cover portion in said closed position, said locking assembly comprising:

a slot, said slot extending through said top and bottom surface of said base portion, said slot being generally positioned in said proximal portion of said base portion;

a latch, said latch being fixedly coupled to said back side of said cover portion, said latch being positioned such that said latch may extend through said slot when said cover portion is in said closed portion, said latch having notch therein, said notch generally facing said pivot bar;

an actuating means for selectively holding and releasing said latch from said slot, said actuating means being generally located between said slot and said peripheral wall of said base portion, said actuating means comprising a lever, said lever being slidably mounted to said bottom surface of said base portion, said lever having a first end and a second end, said second end being generally adjacent to said peripheral wall of said base portion, said lever having a bore therein, said bore being generally adjacent to said first end of said lever, wherein said bore in said lever may be slidably positioned over said slot in said base portion such that said bore in said lever may receive said latch, wherein said lever may be slidably positioned in a locked position such that said notch in said latch receives a portion of said lever;

a biasing means for biasing said lever in said locked position, said biasing means being a spring, said spring being mounted in a channel in said lever, a wall extending upward from and integrally coupled to said bottom surface of said base portion, said wall extending into said channel such that said spring is biased against said wall, said wall being positioned between said spring and said first end of said lever;

a depression in said peripheral wall of said base portion, said depression being generally adjacent to said second end of said lever;

a coupling means for removably coupling said base portion to a user, said coupling means comprising;

a strap, said strap having a first end and a second end, said second end having a hook portion thereon;

a bar, said bar being rotatably coupled to said bottom surface of said base portion, said bar being generally adjacent to said peripheral wall of said base portion, said bar having a longitudinal axis orientated generally perpendicular to said pivot pin;

a bracket, said bracket having a first leg and a second leg, said bracket being generally L-shaped, a free end of said first leg being fixedly coupled to said bottom surface of said base portion such that said second leg extends toward said bar, said bracket being positioned generally adjacent to said peripheral wall of said base portion; and wherein said first end of said strap may be slidably wrapped around said bar and wherein said hook portion may be releasably coupled to said bracket.

* * * * *